US008025477B2

(12) United States Patent
Ganesh et al.

(10) Patent No.: US 8,025,477 B2
(45) Date of Patent: Sep. 27, 2011

(54) PLENUM/PLUG FAN ASSEMBLY

(75) Inventors: Radha K. Ganesh, Rogers, MN (US); Richard D. Williamson, New Brighton, MN (US); Jonathan C. Weeks, Minnetonka, MN (US); Tatyana S. Solomakhova, Moscow (RU)

(73) Assignee: Twin City Fan Companies, Ltd., Minneapolis, MN (US)

( * ) Notice: Subject to any disclaimer, the term of this patent is extended or adjusted under 35 U.S.C. 154(b) by 996 days.

(21) Appl. No.: 11/574,212

(22) PCT Filed: Aug. 24, 2005

(86) PCT No.: PCT/US2005/030082

§ 371 (c)(1),
(2), (4) Date: Sep. 24, 2007

(87) PCT Pub. No.: WO2006/026295

PCT Pub. Date: Mar. 9, 2006

(65) Prior Publication Data

US 2008/0166223 A1 Jul. 10, 2008

Related U.S. Application Data

(60) Provisional application No. 60/604,571, filed on Aug. 26, 2004.

(51) Int. Cl.
*F04D 29/66* (2006.01)

(52) U.S. Cl. ..... 415/119; 415/211.2; 415/224.5; 415/211.1; 415/1

(58) Field of Classification Search ..... 415/211.1, 415/211.2, 119, 226, 206, 207, 224.5; 181/224, 181/225

See application file for complete search history.

(56) References Cited

U.S. PATENT DOCUMENTS

| | | | | |
|---|---|---|---|---|
| 2,269,049 | A * | 1/1942 | Zellweger | 416/175 |
| 2,287,822 | A * | 6/1942 | Odor et al. | 415/185 |
| 2,349,124 | A | 5/1944 | Trotter | |
| 2,439,124 | A * | 4/1948 | Bergstrom | 415/211.1 |
| 4,576,549 | A * | 3/1986 | Lanier | 415/206 |
| 5,749,702 | A | 5/1998 | Datta et al. | |
| 6,030,186 | A * | 2/2000 | Tang | 417/312 |
| 6,217,281 | B1 | 4/2001 | Jeng et al. | |
| 6,267,665 | B1 | 7/2001 | Akhtar | |
| 6,524,064 | B2 | 2/2003 | Chou et al. | |
| 7,001,140 | B2 | 2/2006 | Hustvedt et al. | |
| 7,357,621 | B2 | 4/2008 | Hustvedt et al. | |

OTHER PUBLICATIONS

English Translation of Chinese Office Action from Chinese Patent Application No. 200580035734.2.
Centriflow Plug Fan—Technical Data by FläktWoods; undated; pp. 1-17.

* cited by examiner

*Primary Examiner* — Ninh H Nguyen
(74) *Attorney, Agent, or Firm* — Nawrocki, Rooney & Sivertson, P.A.

(57) ABSTRACT

An aero acoustic fan assembly is provided and generally includes a fan wheel, a frame, and first and second air outlet diffusing structures. The fan wheel generally, and typically includes an axial air inlet delimited by an air inlet cone, an annular air outlet, a back plate, and front plate opposite the back plate. The frame within supports the fan wheel for rotation about a central axis thereof. The first air outlet diffusing structure is supported by a portion of the frame, adjacent the back plate of the fan wheel and includes a peripheral region. The second air outlet diffusing structure is similarly supported by a portion of the frame, adjacent the front plate of the fan wheel, and also includes a peripheral region, air exiting the annular air outlet of the fan wheel passing between the peripheral regions of the diffusing structures.

25 Claims, 8 Drawing Sheets

75% WOV Kwo Size 182

PLENUM/PLUG FAN ASSEMBLY

This is an international regular application filed under 35 U.S.C. §363 claiming priority under 35 U.S.C. §119(e)(1), of provisional application Ser. No. 60/604,571 having a filing date of Aug. 26, 2004.

TECHNICAL FIELD

The present invention generally relates to air moving assemblies, more particularly, to plenum/plug fan assemblies which boost static pressure/dynamic efficiency, and further provide noise reduction, both broadband and tone components thereof.

BACKGROUND OF THE INVENTION

Relatively inexpensive plenum or plug-type fans are well known in the industrial and commercial fan industry. They are commonly sold as an unhoused fan unit by the manufacturers although they are mounted in a suitable support structure that can include a front wall with an air inlet opening formed therein. These fans are used instead of, or to replace, centrifugal type fans which are commonly used in the air handling industry. The wheel of the plenum fan is used to pressurize a surrounding air plenum or housing in which the fan is installed. A number of air ducts can be connected to the housing and these can extend from any direction. In addition to being a reasonably inexpensive fan structure, a plenum or plug fan unit can save space by eliminating a special fan housing, transitions and diffusers commonly characterizing centrifugal air handling system. When required, two or more of these fans can be mounted side-by-side on common or separate support frames.

A common and well known difficulty of plug or plenum fans is that they can be inefficient in their operation and noisy compared to other types of fans. Furthermore, such assemblies are known to require considerably more electrical power for operation of the one or more fans than more efficient units that produce the same amount of or more air flow. With respect to the noise problem, it is noted that with many known plug type fans, low frequency noises are generally produced, and there is no currently available and practical solution to the noise problem. Traditionally, noise reduction in air moving assemblies has been achieved at the cost of dynamic performance, via the inclusion of dissipative silencers. Such silencers typically comprise acoustically lined fan housings, ducting, etc. In an air handling system, such structures create a static pressure drop which results in a lowered static efficiency. Furthermore, dissipative silencers are ill suited to reduce or eliminate the tone component of sound, namely, blade pass frequency tone.

U.S. Pat. No. 5,749,702 (Datta et al.) describes, among other things, a fixed center body for axially directing air flow to and within a bladed fan wheel having an annular air outlet. The center body extends through the axial air intake, and radially expands rearwardly, terminating at an end at the back of the fan wheel, close to the rear plate thereof. Both inlet and outlet structures, including the center body, incorporate sound attenuating material for broadband noise reduction. Increased fan wheel efficiency is alleged as attributable to a solid curved rear end section of the center body, which redirects air flow in a radial direction towards the annular outlet of the fan wheel. Furthermore, a wall, spaced from a fixed sidewall or front wall of a fan support structure so as to be positioned behind the fan wheel, is further provided. The additional wall is preferably filled with sound attenuating material, and more preferably still, has a perforated front surface facing the back plate of the fan wheel.

U.S. Pat. No. 5,426,268 (Yazici et al.) describes combined utilization of air duct inlet and outlet silencer apparatuses for an air handling system. Both apparatuses include interior walls, arranged between interior and exterior walls thereof, comprised of sound attenuating material, with at least portions of the interior walls constructed of perforated metal sheets. In the outlet duct apparatus, the main passageway is substantially straight and increases in transverse cross-section from the inlet to the outlet. The transverse cross-section changes from circular at the end of the passageway adjacent the fan to rectangular at the opposite end.

U.S. Pat. No. 5,066,194 (Amr et al.) describes a fan orifice structure intended for use in conjunction with an outside enclosure, usually containing a heat exchanger and compressor of an air conditioner. The orifice is defined by an annular curved surface that extends downwardly from a top wall of the cover. The curved surface is generated by rotating a planar and curvilinear line about a coplanar axis of generation. It is said that the contour of the orifice enhances fan efficiency and reduces radiated noise. The orifice cover is made from plastic materials by a molding process.

U.S. Pat. No. 4,576,549 (Lanier) is generally directed to a centrifugal fan having a plurality of vortex generators fixed onto the outer wall of an annular member leading into an air inlet of the fan wheel. An inlet cone is shown as a concave annular form tapered inwardly from the larger diameter air inlet in the fan wheel plate. Vortex generators are shown as formed plates having lateral edges contoured to fit the curved annular wall of the inlet cone. It is believed that such structures, so arranged, permit merger of skin friction induced air current with the lower velocity air being discharged from the rotating fan wheel blades As is readily appreciated, it remains advantageous to provide a fan unit which is simple to build and construct which employs a bladed fan wheel having an axial air intake and an annular air outlet, and at least one outlet diffuser for directing airflow from the fan wheel such that static efficiency is improved, and noise is greatly reduced. It is further advantageous to enhance the noise reduction capabilities of fan assemblies for air handling systems, more particularly, both the broadband and tone aspects thereof.

SUMMARY OF THE INVENTION

Fan silencers have traditionally achieved noise reduction at the expense of a static pressure drop resulting in an increase in power input to the fan, and consequently lowering its static efficiency. The subject invention achieves noise reduction by boosting the static pressure and static efficiency. Principles of dissipative silencer design have been employed for both the fan wheel inlet and outlet. Outlet or discharge considerations included principles of aerodynamic vane-less diffuser design.

In a first embodiment, a rear (hub) diffuser element, e.g., ring, is utilized adjacent the back plate of the fan wheel. The subject rear diffuser ring, as well as structures of the further embodiments, are readily, and preferably, but not necessarily, adapted for enhanced sound attenuation as will later be discussed.

In a further embodiment, a specially configured front (shroud) diffuser element, e.g., ring, is utilized, more generally, a structure which slows the air discharge velocity from the fan wheel/fan unit, is provided. In yet a further embodiment, an inlet diffuser is provide to selectively guide air flow into the fan wheel, preferably, but not necessarily, the inlet diffuser incorporates a blade pass frequency (BPF) tuned resonator. More specific features and advantages obtained in view of those features will become apparent with reference to the drawing figures and DETAILED DESCRIPTION OF THE INVENTION.

DETAILED DESCRIPTION OF THE INVENTION

Figure 1:
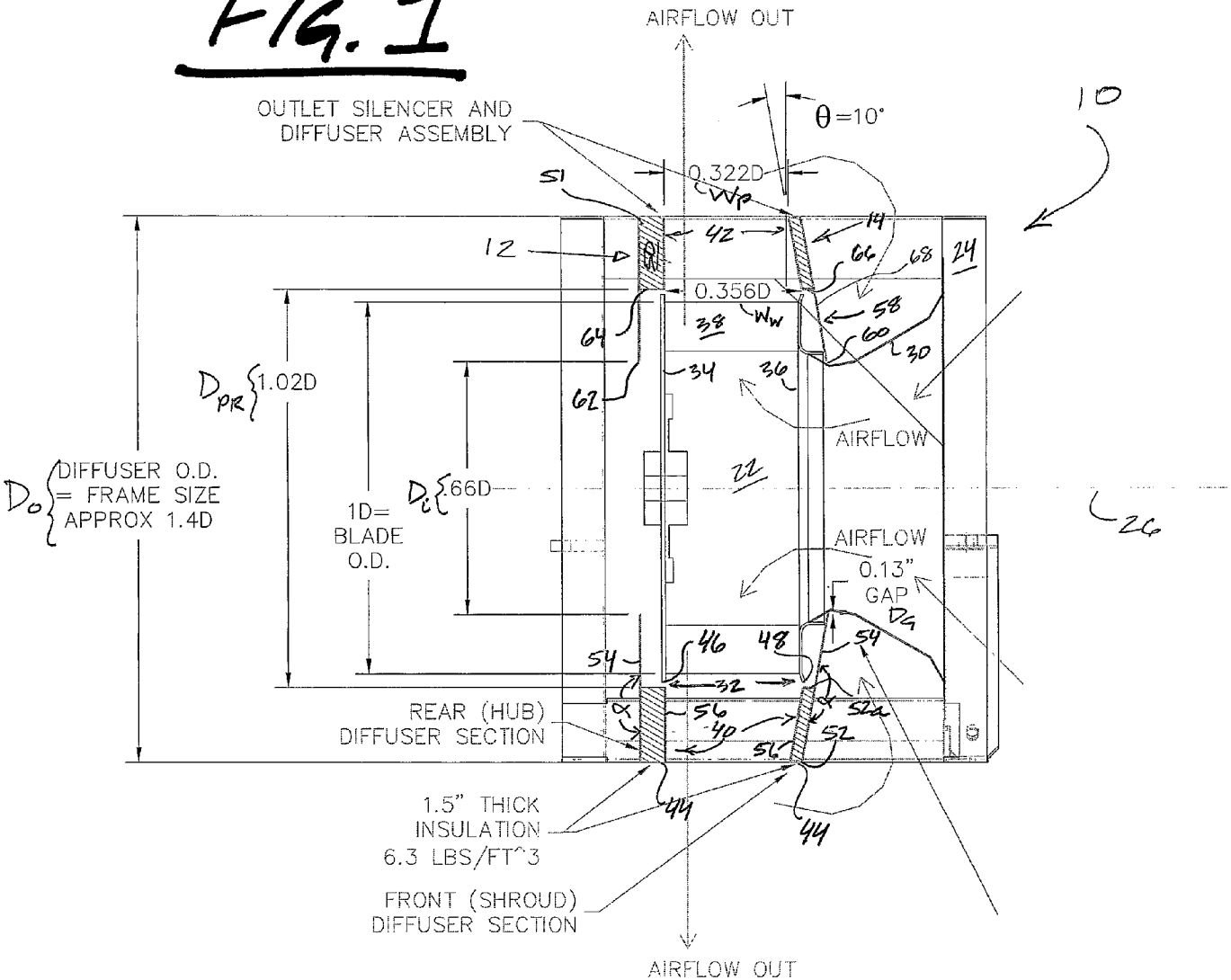
FIG. 1 is a schematic cross-section view taken through the axial center of the fan unit or assembly of the subject invention.
Figure 2:
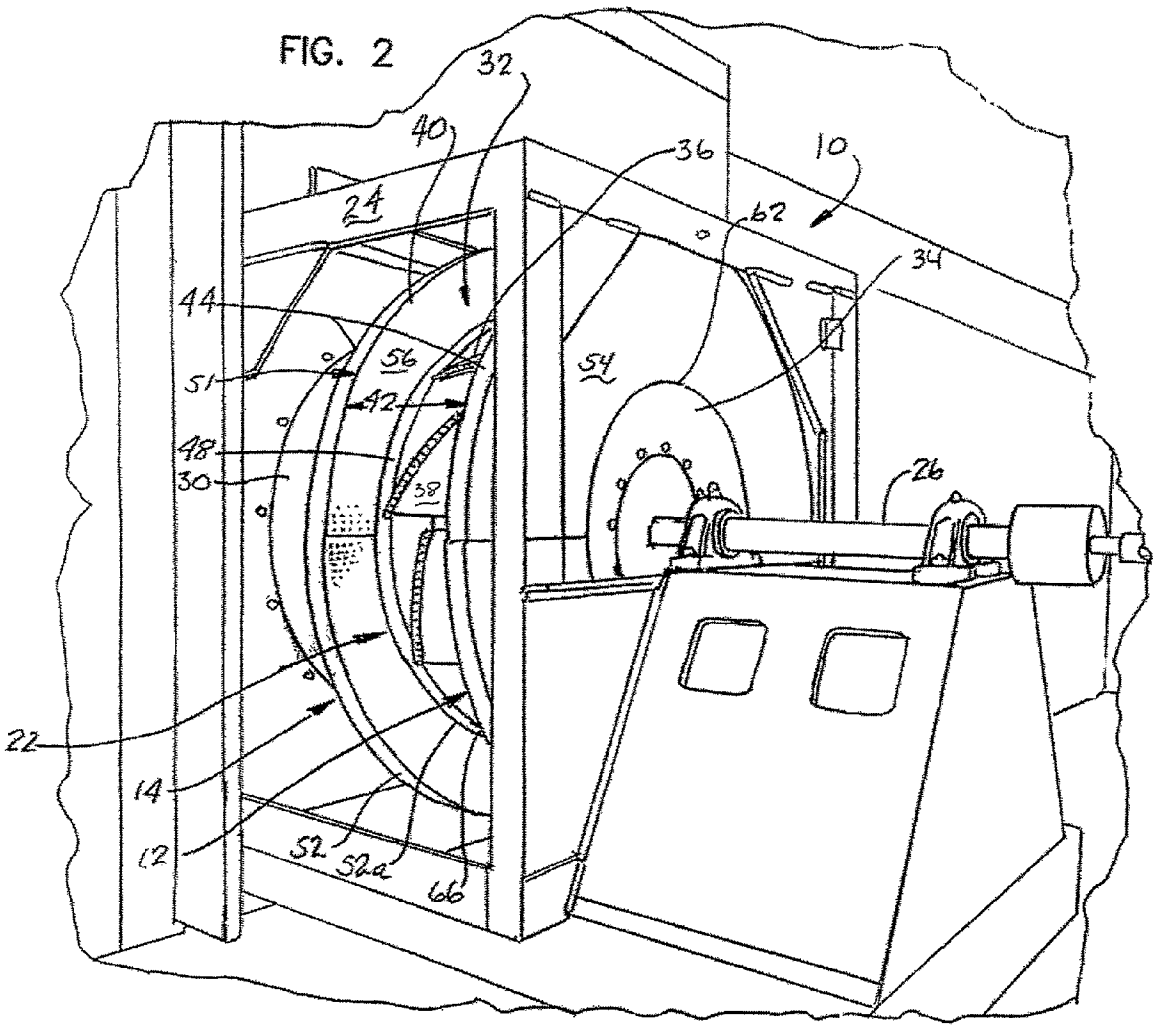
FIG. 2 is an perspective end view, shaft side, of the assembly of FIG. 1, illustrating annular air outlet related structures, e.g., air outlet diffusing elements.
Figure 3:
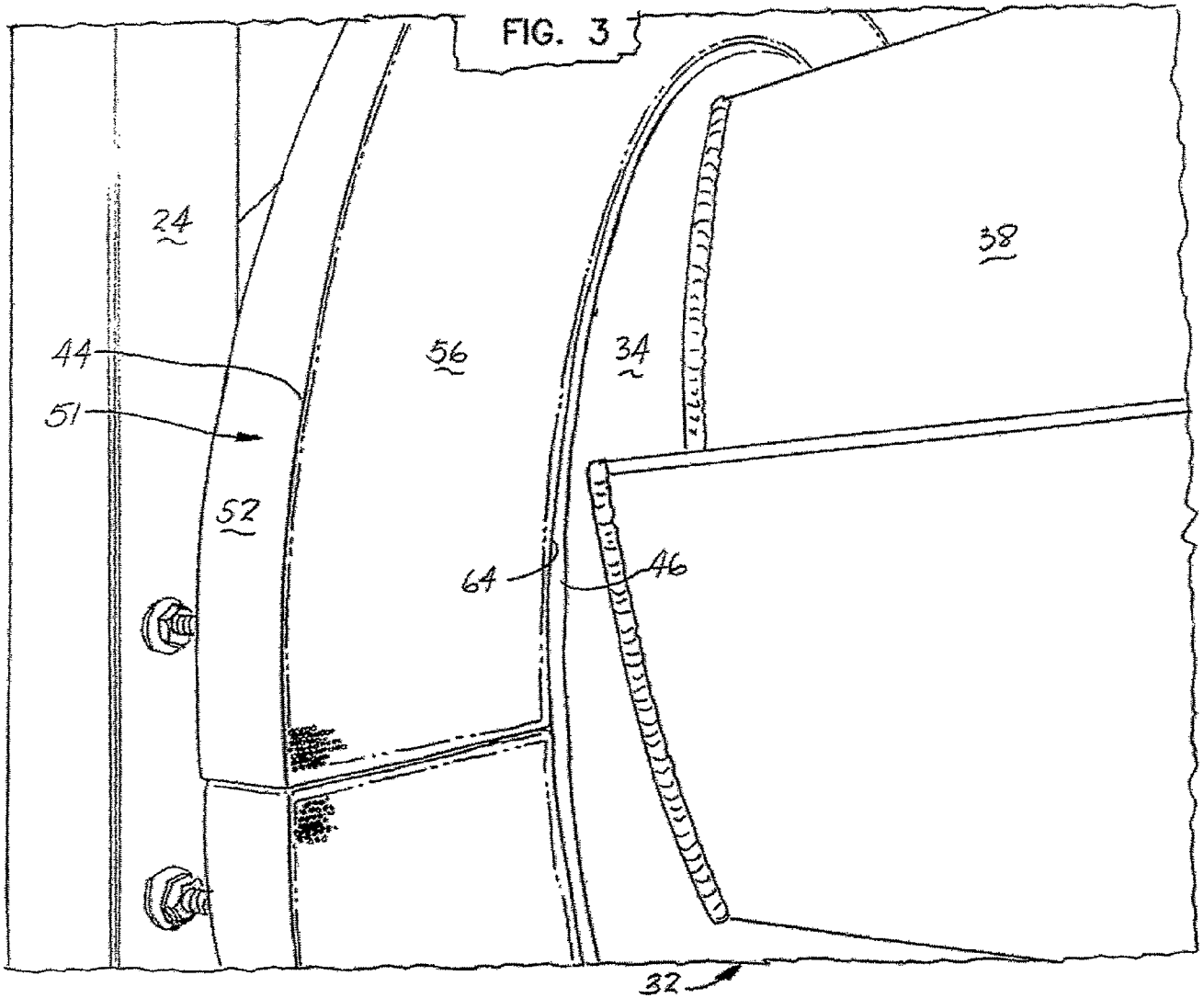
FIG. 3 is a perspective sectional side view of the assembly of FIG. 1, illustrating the relationship between, among other things, the back plate and acoustic element of the diffusing structure.
Figure 4:
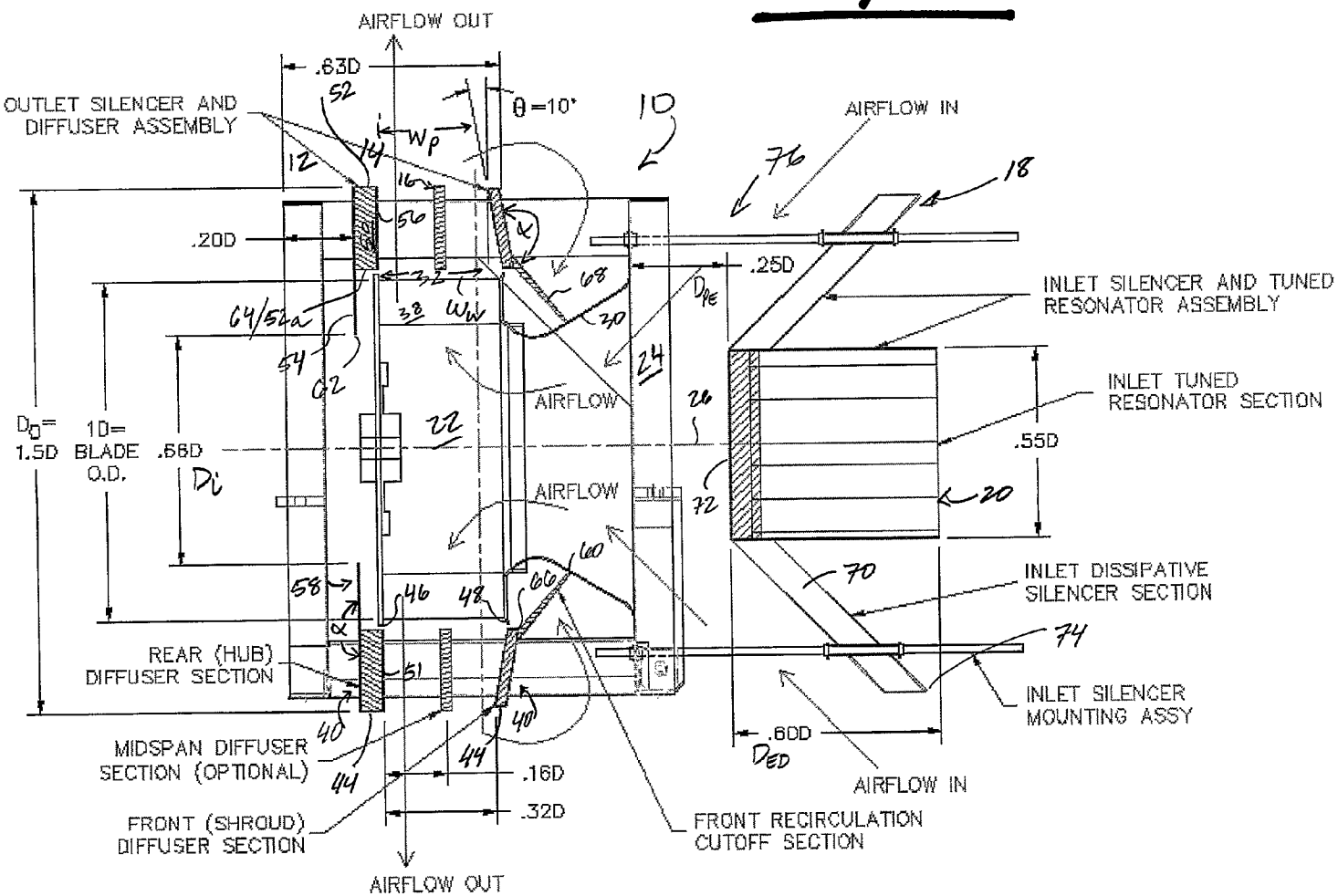
FIG. 4 is a schematic cross-section view taken through the axial center of an alternate embodiment of the fan unit or assembly of the subject invention.

As a preliminary matter, fan assemblies 10 of the subject invention are generally shown in FIGS. 1 & 4, the assembly of FIG. 4 including features of the assembly of FIG. 1, e.g., a rear or hub diffusing structure 12, modified features of the assembly of FIG. 1, e.g., an alternately configured front or shroud diffusing structure 14, and supplemental select advantageous features, e.g., a mid-span diffusing structure 16 and/or an air inlet diffusing structure 18 optionally having an inlet tuned resonator section 20. Features of the assembly of FIG. 1 are further illustrated in FIGS. 2 & 3, and features of the assembly of FIG. 4 are selectively illustrated in FIGS. 5 & 6. Finally, aero-acoustic performance of the assembly of the subject invention in relation to conventional known fan wheel/fan assemblies is presented in FIGS. 7 & 8 vis-a-vis comparative representations of both static efficiency and specific sound power.

With reference now to FIGS. 1 & 4, preferred and optional assemblies of the subject invention, shown or otherwise, generally include a fan wheel 22 and a frame or base 24 within which or on which the fan wheel 22 is supported for rotation, more particularly, rotation about a central axis 26 thereof, such arrangements being conventional and well known to plenum/plug fan artisans. The fan wheel 22 generally has an axial air inlet, delimited by an air inlet cone 30 forwardly supported by the frame 24, an annular air outlet 32, a back plate 34, a front plate 36 spaced apart or opposite the back plate 34, and several blades 38 disposed between the plates 34, 36.

The assembly 10 further includes rear or hub diffusing structure 12, i.e., a first air outlet diffusing structure or element (e.g., a ring, or fractions thereof, i.e., halves, thirds, quarters, etc. as will later be described), depending or otherwise supported by the frame 24, or a portion thereof, adjacent the back plate 34 of the fan wheel 32, and front or shroud diffusing structure 14 i.e., a second air outlet diffusing element (e.g., a ring, or fractions thereof, i.e., halves, thirds, quarters, etc. as will later be described), depending or otherwise supported by the frame 24, or portion thereof, adjacent the front plate 36 of the fan wheel 32. As will later be detailed, each of the first and second air outlet diffusing structures include a peripheral region or segment 40, air exiting the annular air outlet 32 of the fan wheel 32 passing between the peripheral regions 40 of the diffusing elements 12, 14.

With particular reference to FIG. 4, the assembly of FIG. 1, or variants thereof, advantageously, but not necessarily, may further, selectively include mid-span diffusing structure 16, air inlet diffusing structure or assembly 18, or both in combination as illustrated. The mid-span diffusing structure 16, i.e., a third air outlet diffusing element (e.g., a ring, or fractions thereof, i.e., halves, thirds, quarters, etc. as will later be described), depends or is otherwise supported by the frame 24, or portion thereof, intermediate the first 12 and second 14 diffusing structures. The assembly of the subject invention advantageously includes such mid-span element when the fan wheel diameter D exceeds about twenty inches.

The air inlet diffusing assembly 18 (FIGS. 4 & 5), optionally equipped with inlet tuned resonator 20 (FIG. 4), depends or is otherwise supported by the frame 24 so as to extend from a forward portion thereof, more particularly and preferably, to extend therefrom in a spaced apart relationship with the air inlet cone 30, so as to define or delimit a circumferential air ingress passage 42 for the assembly generally.

Prior to a further or more developed discussion of the air outlet diffusing structures, it is to be appreciated that in addition to prospective air handling applications, select structures of the assembly described herein (e.g., one or more of the air outlet diffusing elements, and or variants of the air inlet diffusing structure) may advantageously be supplied as a "kit" for after-market conversion of in-place, operational air handling assemblies. In furtherance of retrofitting such systems, select structures, e.g., first, second, and/or third air outlet diffusing elements may be fractionally supplied, preferably, but not necessarily, in halves (see e.g., FIG. 2 with regard to hub 12 and shroud 14 structures, and FIG. 3 with regard to hub structure portions 12*a*, 12*b*) for incorporation into the pre-existing assembly as the specific application warrants. It is to be further appreciated, and understood, that variations in fabrication methodology, and modifications of one or more elements, structures, assemblies, or sub-assemblies of or relating to the disclosed invention necessitated thereby, is contemplated.

Referring now generally to FIGS. 1-3, or FIGS. 4-6, the hub 12 and shroud 14 diffusing structures include peripheral regions or segments 40, as previously noted, more particularly, peripheral regions 40 adjacent or proximal outer free edges 44, i.e., outer circumferential edges, of each of the structures. The peripheral regions 40, which are radially adjacent circumferential edges 46, 48 of the back 34 and front 36 plates respectively (see e.g., FIGS. 1, 3 & 4), are advantageously adapted so as to include (i.e., house, contain, etc.) an acoustic insulation 50. For example, the peripheral regions 40 of each of the structures 12, 14 may include compartment defining walls, e.g., opposing radially spaced apart side walls 52 extending from a portion of a base 54 of each of the diffusing structures 12, 14 united by a perforated plate 56, within which the sound attenuating material 50 resides. Sheets, i.e., diffusing structure surfaces, exposed to air flow (i.e., in direct contact therewith) are perforated, more generally adapted to "admit" noise into the insulating material for "capture" therein. Fabrication of the inlet and outlet diffuser elements in this way enhances broadband sound attenuation.

Omission of the perforations from the air exposed surfaces nonetheless provides a boost in static pressure/efficiency.

Figure 5:
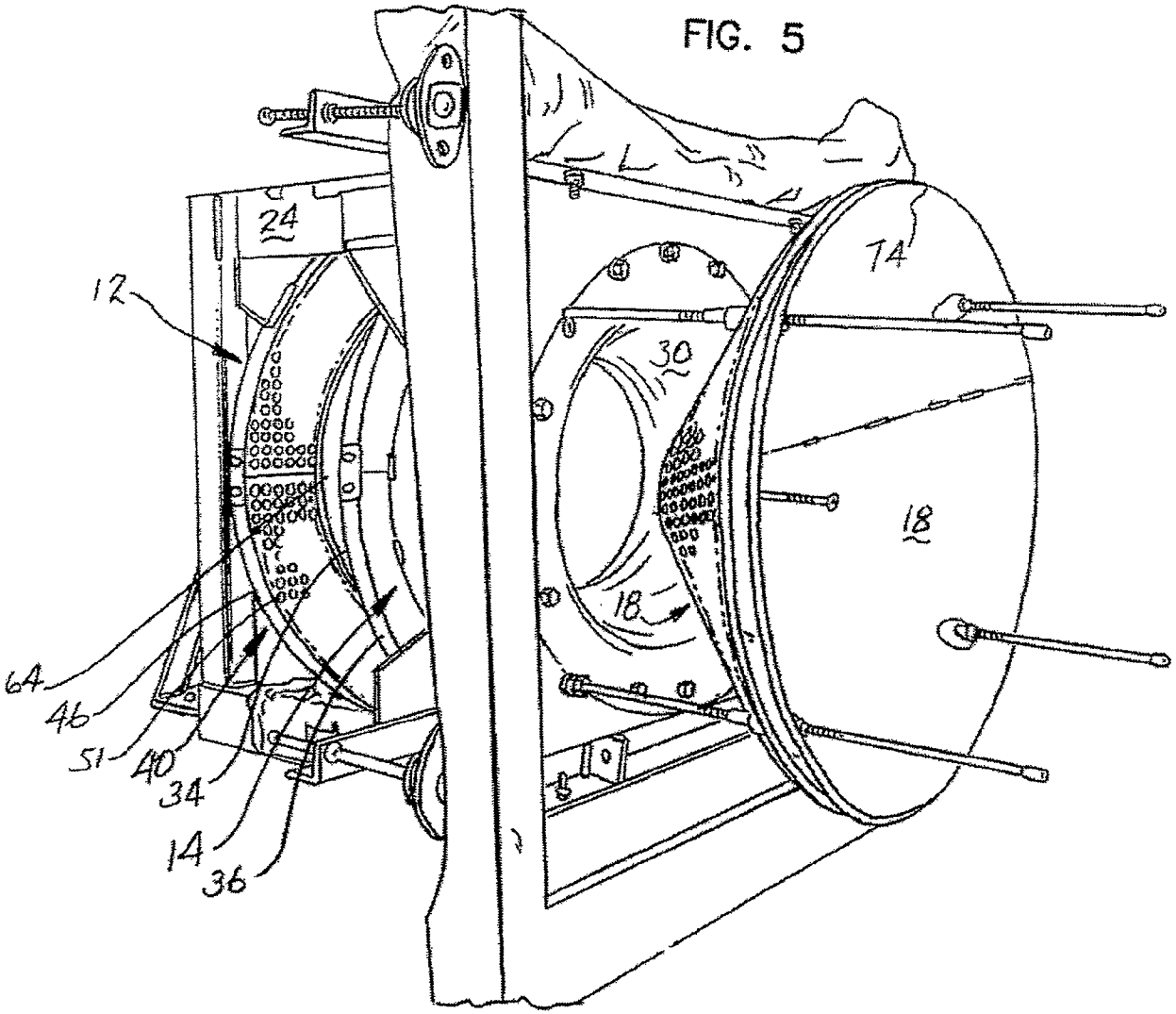
FIG. 5 is an perspective end view of the generally assembly of FIG. 4, illustrating fan inlet particulars.
Figure 6:
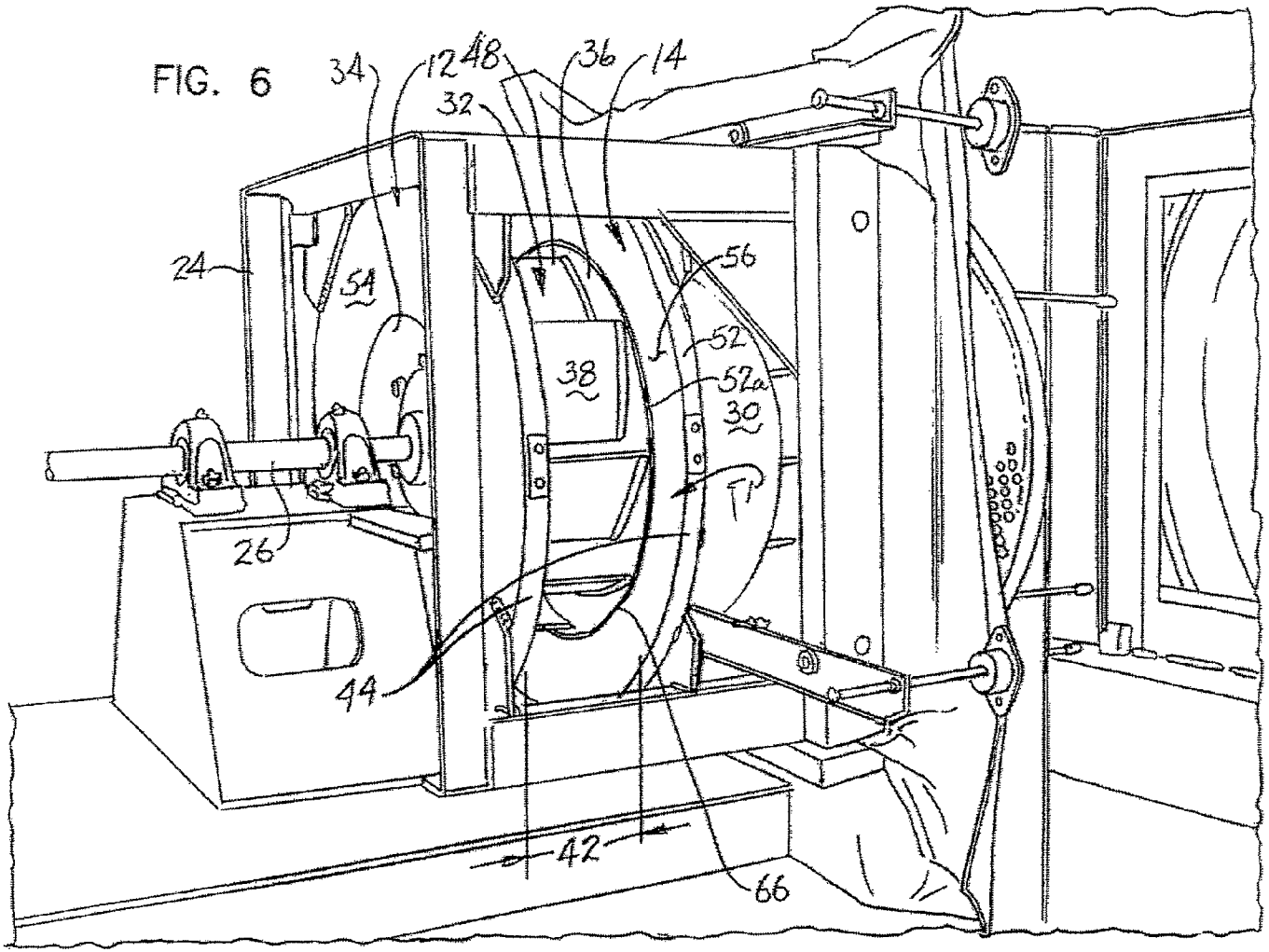
FIG. 6 is a perspective side view of the general assembly of FIG. 4, illustrating fan outlet particulars.

Advantageously, as shown in FIG. 4, the shroud diffusing structure 14 may be further adapted to include insulation beyond a boundary of its peripheral region 40, more particularly, adapted to retain insulation throughout the entirety of its radial extent (i.e., adapted to include insulation in a region or segment 58 radially extending toward an inner circumferential periphery 60 thereof). Similarly, as shown in FIGS. 4 & 5, both the mid-span diffusing structure 16 and air inlet diffusing structure 18 preferably include sound insulative material 50.

With regard to the sound insulating material 50, the density thereof is preferably within the range of about 0.5 to 8.0 pounds per cubic foot, with the preferred material thickness within the range of about 0.05 to 0.1 times the diameter (D) of a the fan wheel, i.e., 1 D=fan wheel outside diameter (OD). One suitably known combination of thickness/density, wherein 1 D=18.25 inches, is 1.5 inch thick insulation having a density of about 6.3 pounds per cubic foot, such material being commercially available and well known.

In connection to the air contacting surfaces of the insulated portions of the one or more air outlet diffusing elements, and/or air inlet diffusing structure, as has been heretofore described, perforated surfaces are especially advantageous. Although a variety of perforated surface configuration have, or are likely to have utility, those characterized by a transparency index (TI), defined by Theodore J. Schultz, "Acoustic Uses for Perforated Metals," within a range of about 1,000 to 20,000 are desirable. The perforated steel plate used for the diffuser prototype is 20 GA cold rolled steel, with 0.060 diameter holes spaced on 3/32 inch staggered centers. The material has approximately one hundred twenty six holes per square inch, and a TI value of 13,887.

With reference again to FIGS. 1/4, the hub diffusing structure 12 is generally configured within the assembly of the subject invention, in all its contemplated embodiments, to be orthogonally disposed with respect to axial centerline 26 of the fan wheel 32, i.e., substantially parallel to the back plate 34, and spaced apart therefrom. Preferably configured as an annular element, the structure has an interior circumferential edge 62 opposite its outer circumferential edge 44, or the sidewall 52 associated therewith, and an intermediate circumferential edge 64 therebetween, namely, that associated with the interior sidewall 52*a* of the insulation retaining compartment 51.

Dimensionally, the diffuser outside diameter ($D_o$), i.e., maximum dimension from opposing sides on the outer circumferential edge 44, is within the range of about 1.3-1.6 D, and typically substantially equivalent to the frame size; the diffuser inside diameter ($D_i$), i.e., maximum dimension from opposing sites on the interior circumferential edge 62, being within the range of about 0.6-0.7 D; and, the diameter associated with the commencement of the peripheral region 40 ($D_{pr}$), i.e., maximum dimension from opposing sites on the intermediate circumferential edge 64 or interior sidewall 52*a* of the insulation retaining compartment 51, is within the range of about 1.01-1.02 D. With such configuration, the perforated surface 56 of the peripheral region 40 of the hub diffusing structure 12 radial extends from the back plate 34, with clearance as noted (i.e., $(D_{pr}-D_{bp}\{\sim 1\ D\})/2$), so as to be substantially coplanar therewith, and in all cases, delimits a "rear" boundary or guide for air exiting from the annular air outlet 32.

With continued reference to FIGS. 1/4, the shroud diffusing structure 14, like the hub diffusing structure 12, is preferably configured as an annular element, the structure having interior circumferential edge 60 opposite its outer circumferential edge 44 or the sidewall 52*a* associated therewith, and an intermediate circumferential edge 66 therebetween, namely, that associated with the interior sidewall 52*a* of the insulation retaining compartment 51 coextensive with the peripheral region 40 as previously discussed. Although dimensionally similar to/with the hub diffusing structure, at least with respect to the configuration of FIG. 1, i.e., the ranges of $D_o$, $D_i$, and $D_{pr}$ for the shroud diffusing structure 14 being substantially equivalent to the ranges previously described for $D_o$, $D_i$, and $D_{pr}$ for the hub diffusing structure 12.

Advantageously, as shown in FIGS. 1 & 4, interior 60, exterior 44 and intermediate 66 circumferential edges of the shroud diffusing structure 14 are not co-planar (i.e., the structure may suitably be a ring of frusto-conical arrangement), however, the edges may be, so as to thereby essentially resemble the configuration for the hub diffusing structure 12. With the contemplated configurations, several alternative spacings between free edges 44 of peripheral regions 40 of the diffusing elements 12, 14, i.e., the "width" of passage 42 for air exiting the annular outlet 32 of the fan wheel 22 ($W_p$), result: (1) $W_p$ is less than a spacing between a free edges 46, 48 of the back 34 and front 36 plates ($W_w$), as show in FIGS. 1 & 4 (i.e., $W_p<W_w$), more particularly, as a function of fan wheel diameter D, $W_w$ is advantageously within the range of about 0.3 to 0.4 D (0.356 D), with $W_p$ being a function of $W_w$ and θ; (2) $W_p$~/=$W_w$; and, (3) $W_p>W_w$. Alternately, it is believed advantageous to have an angle of inclination θ between a plane normal to the axial centerline 26 of the fan wheel 32, and passing through (i.e., including) the intermediate circumferential edge 66 (or front plate 36 of the fan wheel 32), and a plane coextensive with the perforated surface 56 of the peripheral region 40 thereof, within the range of about −5 to 25° (10° indicated in FIGS. 1 & 4).

The shroud diffusing structure 14 is generally segmented, a shroud segment 68 depending from the peripheral region thereof, more particularly, extending radially inward therefrom. With regard to the segmentation of the shroud diffusing structure of FIG. 1, the segment or region 68 adjacent the peripheral region 40 thereof extends so as to be planar therewith, i.e., at an angle α of 180°. The hub diffusing structure 12 is likewise characterized by such arrangement. With reference to FIG. 4, the interior segment 68 of the shroud structure 14 is shown advantageously extending from the peripheral region 40 at an angle α<180°. As was previously discussed, this portion of the shroud diffusing structure is advantageously adapted to include, i.e., carry, retain, etc., acoustic insulation 50. Finally, it is further advantageous that the spacing between the interior circumferential edge 60 of the shroud diffusing structure 14 and the air inlet cone 30, $D_G$, be within the range of about 0.01 to 0.025 D. Functionally, the shroud segment 68 depending from the peripheral region 40 thereof acts as a front re-circulation cutoff, essentially preventing short circuiting of discharge air to the inlet of the fan wheel.

With particular reference to FIGS. 4 & 5, the air inlet diffusing structure 18, preferably configured as a conical frustum, generally includes a sidewall 70 which delimits first and second circumferential ends or edges, more particularly, an inlet cone proximal circumferential edge 72, hereinafter "proximal" circumferential edge, and an inlet cone distal proximal edge 74, hereinafter, "distal" circumferential edge. As is readily appreciated with reference to FIGS. 4 & 5, the diameter of the proximal end is less than that of the distal end. With the proximal end being a closed end, an annular air inlet path 76 is provided for the fan wheel 32 of the assembly 10, more particularly, the inlet cone 30 associated therewith.

As noted in connection to the one or more outlet diffusing structures, the air inlet diffusing structure 18 is likewise adapted so as to include/incorporated insulative material 50. As shown in FIG. 5, the air inlet diffusing structure 18 includes opposingly paired, spaced apart sidewalls 70, 70*a*, i.e., inner and outer sidewalls, filled or fillable with insulation. The outer sidewall, i.e., the air engaging sidewall, or sidewall surface, preferably comprises a perforated sheet.

The resonator assembly of FIG. 4, more particularly, a blade pass frequency tuned resonator 20, centrally extends from the tapered, closed end of the inlet diffuser structure 18, i.e., the proximal end. As to the interrelatedness of the subject structure in relation to other elements of the assembly, the diffuser outside diameter ($D_o$), i.e., maximum dimension from opposing sites on the outer or distal circumferential edge 74, is within the range of about 1.3-1.6 D, and typically substantially equivalent to the frame size; the diffuser inside diameter ($D_i$), i.e., maximum dimension from opposing sites on the interior or proximal circumferential edge 72, being within the range of about 0.6 to 0.7 D (0.55 D); the distance between the mouth of the inlet cone and the proximal end of the structure ($D_{PE}$) is within the range of about 0.2 to 0.3 D (0.25 D); and, the extended distance of the inlet tuned resonator 20 from the proximal end of the inlet diffusing structure 18 ($D_{ED}$) is within the range of about 0.55 to 0.65 D (0.60 D).

Figure 7:
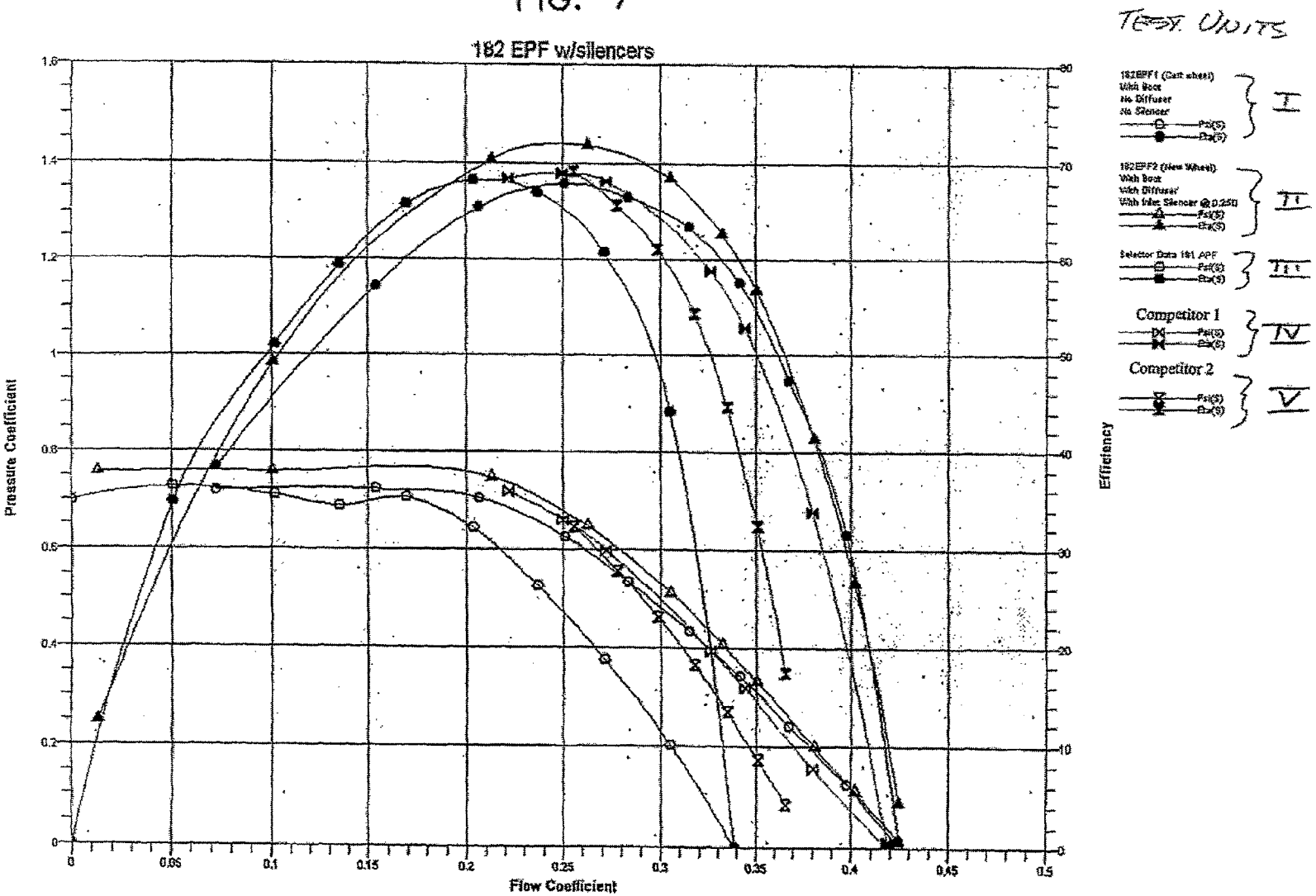
FIG. 7 is a plot of pressure coefficient/efficiency as a function of flow coefficient for select fan units, including that of the subject invention; and, FIG. 8 is a plot of sound power as a function of frequency and rotational speed, more particularly, the base ten log of the quotient thereof, for select fan units, including that of the subject invention.
Figure 8:
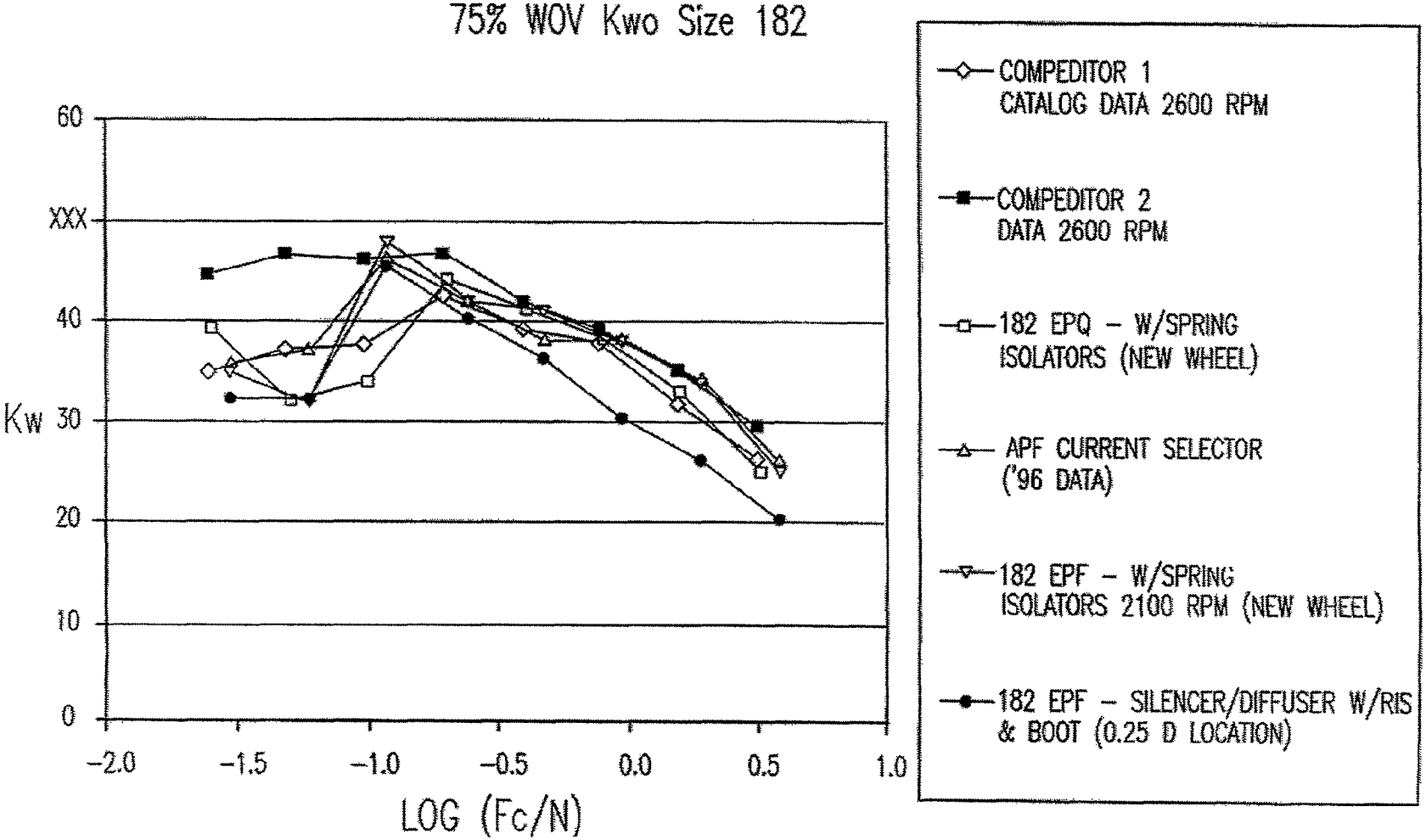

With reference now to FIGS. 7 & 8, performance of the assembly of the subject invention is evidenced, more particularly, both static efficiency and specific sound power is indicated therefore, in relation to conventional fan wheel/fan assemblies for air handling systems. Five (5) test units, indicated in the legend of FIG. 4 as units I-V, were subject to testing, with the results indicated. As shown, the diffusers of the subject fan assembly (II), boost the static efficiency (SE) of the plenum fan by up to 5%. The vane less diffuser outlet silencer also improves the pressure generating capability of the fan. As indicated in the legend, test unit I omits the structures of the subject invention, namely those of test unit II, with test units III-IV being commercially available fan units.

Noise reduction using both the outlet and inlet diffuser elements is indicated in FIG. 5. Six (6) test units, indicated in the legend of FIG. 5 as units I-VI, were subject to testing, with the results indicated. Test units I-IV, as indicated, are commercially available fan units, with units V and VI indicated embodiments of the subject invention. As noted, blade pass frequency (BPF) tone is reduced by 3 dB, with as much as 8 dB reduction being achieved at the higher frequencies.

With reference now to Table 1, inlet and outlet diffuser performance is indicated for an 18.25" OD bare fan wheel, no bearing support on inlet, having 9 blades (i.e., 182 EPFN), with and without the diffuser elements of the subject invention. The outlet sound power level (dB), indicated by Lw, is for the following frequencies (i.e., 1-8), respectively: 63 hz, 125, 250, 500, 1000, 2000, 4000, and 8000. Furthermore, LwA indicates an inlet A weighting. As can be seen, static efficiency improves dramatically for higher pressures where the vane less diffuser works best and, sound quality improves by various levels across all bands consistently, and may be further improved with selective perforation of the air contacting wall surface of the diffuser element, and further still, via utilization of a resonator to tune out BPF tone.

There are other variations of the subject invention, some of which will become obvious to those skilled in the art. It will be understood that this disclosure, in many respects, is only illustrative. Changes may be made in details, particularly in matters of shape, size, material, and arrangement of parts, as the case may be, without exceeding the scope of the invention.

TABLE 1

182 EPFN inlet and outlet silencer performance

| | | | | | | | Lw | | | | | | | | |
|---|---|---|---|---|---|---|---|---|---|---|---|---|---|---|---|
| Fan | Silencer? | % WOV | CFM | SP | BHP | SE | 1 | 2 | 3 | 4 | 5 | 6 | 7 | 8 | LwA |
| 182 EPFN | Silencer | 90 | 6966 | 1.13 | 3.22 | 38.4 | 79 | 80 | 94 | 89 | 85 | 81 | 80 | 72 | 91 |
| | No Silencer | 90 | | | 3.07 | 40.3 | 82 | 84 | 96 | 92 | 89 | 88 | 84 | 77 | 95 |
| | Silencer | 75 | 5766 | 2.87 | 3.95 | 65.9 | 79 | 79 | 92 | 87 | 83 | 77 | 73 | 67 | 89 |
| | No Silencer | 73 | | | 4.08 | 63.8 | 82 | 83 | 94 | 91 | 88 | 84 | 80 | 71 | 93 |
| | Silencer | 60 | 4656 | 4.11 | 4.20 | 71.6 | 81 | 78 | 91 | 85 | 82 | 76 | 71 | 65 | 88 |
| | No Silencer | 59 | | | 4.44 | 67.7 | 82 | 82 | 92 | 89 | 84 | 81 | 76 | 69 | 90 |

Silencer Test Ids
Air = 182EPF2
Sound = 182EPF4
Legend:
WOV: wide open volume
SP: static pressure
SE: static efficiency (%)
Lw: sound power level at output (db)
Lw 1-8: octive frequencies, hz: 63/125/250/500/1,000/2,000/4,000/8,000
LwA: inlet A weighting (db)
182 EPFN: 18.25 Blade OD, 9 blade, no bearing support on inlet

What is claimed is:

1. A fan assembly comprising:

a. a fan wheel having an axial air inlet delimited by an air inlet cone, an annular air outlet, a back plate, and front plate opposite said back plate;

b. a frame within which said fan wheel is supported for rotation about a central axis thereof;

c. first air outlet diffusing structure supported by a portion of said frame adjacent said back plate of said fan wheel, said first air outlet diffusing structure comprising a peripheral region;

d. a second air outlet diffusing structure supported by a portion of said frame adjacent said front plate of said fan wheel, said second air outlet diffusing structure comprising a peripheral region, air exiting said annular air outlet of said fan wheel passing between said peripheral regions of said diffusing structures, and e. a third air outlet diffusing structure supported by a portion of said frame intermediate said first and second air outlet diffusing structures, a spacing between free edges of peripheral regions of said diffusing structures being less than a spacing between a free edge of said back plate and a free edge of said front plate.

2. A fan assembly comprising:

a. a fan wheel having an axial air inlet delimited by an air inlet cone, an annular air outlet, a back plate, and front plate opposite said back plate;

b. a frame within which said fan wheel is supported for rotation about a central axis thereof;

c. first air outlet diffusing structure supported by a portion of said frame adjacent said back plate of said fan wheel, said first air outlet diffusing structure comprising a peripheral region;

d. a second air outlet diffusing structure supported by a portion of said frame adjacent said front plate of said fan wheel, said second air outlet diffusing structure comprising a peripheral region, air exiting said annular air outlet of said fan wheel passing between said peripheral regions of said diffusing structures;

e. a third air outlet diffusing structure supported by a portion of said frame intermediate said first and second air outlet diffusing structures; and, f. an air inlet diffusing assembly supported by a portion of said frame adjacent said axial air inlet of said fan wheel, said air inlet diffusing assembly comprising a dissapative silencer.

3. A fan assembly comprising:

a. a fan wheel having an axial air inlet delimited by an air inlet cone, an annular air outlet, a back plate, and front plate opposite said back plate;

b. a frame within which said fan wheel is supported for rotation about a central axis thereof;

c. first air outlet diffusing structure supported by a portion of said frame adjacent said back plate of said fan wheel, said first air outlet diffusing structure comprising a peripheral region;

d. a second air outlet diffusing structure supported by a portion of said frame adjacent said front plate of said fan wheel, said second air outlet diffusing structure comprising a peripheral region, air exiting said annular air outlet of said fan wheel passing between said peripheral regions of said diffusing structures;

e. a third air outlet diffusing structure supported by a portion of said frame intermediate said first and second air outlet diffusing structures; and, f. an air inlet diffusing assembly supported by a portion of said frame adjacent said axial air inlet of said fan wheel, said air inlet diffusing assembly comprising a tuned resonator section extending from a dissapative silencer.

4. A fan assembly comprising:

a. a fan wheel having an axial air inlet delimited by an air inlet cone, an annular air outlet, a back plate, and front plate opposite said back plate;

b. a frame within which said fan wheel is supported for rotation about a central axis thereof;

c. first air outlet diffusing structure supported by a portion of said frame adjacent said back plate of said fan wheel, said first air outlet diffusing structure comprising a peripheral region;

d. a second air outlet diffusing structure supported by a portion of said frame adjacent said front plate of said fan wheel, said second air outlet diffusing structure comprising a peripheral region, air exiting said annular air outlet of said fan wheel passing between said peripheral regions of said diffusing structures; and, e. an air inlet diffusing assembly supported by a portion of said frame adjacent said axial air inlet of said fan wheel, said air inlet diffusing inlet defining an annular air inlet proximal said air inlet cone, said air inlet diffusing assembly comprising a dissapative silencer.

5. The fan assembly of claim 4 wherein said air inlet diffusing assembly further comprises a tuned resonator section extending from said dissapative silencer.

6. A fan assembly comprising:

a. a fan wheel having an axial air inlet delimited by an air inlet cone, an annular air outlet, a back plate, and front plate opposite said back plate;

b. a frame within which said fan wheel is supported for rotation about a central axis thereof;

c. first air outlet diffusing structure supported by a portion of said frame adjacent said back plate of said fan wheel, said first air outlet diffusing structure comprising a peripheral region;

d. a second air outlet diffusing structure supported by a portion of said frame adjacent said front plate of said fan wheel, said second air outlet diffusing structure comprising a peripheral region, air exiting said annular air outlet of said fan wheel passing between said peripheral regions of said diffusing structures; and, e. an air inlet diffusing assembly supported by a portion of said frame adjacent said axial air inlet of said fan wheel, a spacing between free edges of peripheral regions of said diffusing structures being less than a spacing between a free edge of said back plate and a free edge of said front plate.

7. A fan assembly comprising:

a. a fan wheel having an axial air inlet delimited by an air inlet cone, an annular air outlet, a back plate, and front plate opposite said back plate;

b. a frame within which said fan wheel is supported for rotation about a central axis thereof;

c. first air outlet diffusing structure supported by a portion of said frame adjacent said back plate of said fan wheel, said first air outlet diffusing structure comprising a peripheral region;

d. a second air outlet diffusing structure supported by a portion of said frame adjacent said front plate of said fan wheel, said second air outlet diffusing structure comprising a peripheral region, air exiting said annular air outlet of said fan wheel passing between said peripheral regions of said diffusing structures; and, e. an air inlet diffusing assembly supported by a portion of said frame adjacent said axial air inlet of said fan wheel, a spacing between free edges of peripheral regions of said diffusing structures being substantially equal to a spacing between a free edge of said back plate and a free edge of said front plate.

8. An aero acoustic diffuser assembly for a plenum/plug fan, said assembly comprising a first outlet diffusing structure having at least two portions for support by a frame for the fan adjacent a back plate thereof, a second outlet diffusing structure having at least two portions supported by the frame for the fan adjacent the front plate thereof, said first and said second outlet diffusing structures configured so as to extend beyond free edges of the front and back plates of the fan so as to delimit an air discharge passage adjacent an annular air outlet for the fan, a cross-section of said air discharge passage being less than a cross-section of the annular air outlet for the fan, and an air inlet diffuser assembly supportable in a spaced apart condition adjacent the air inlet cone of the fan.

9. A fan assembly comprising:

a. a fan wheel having an axial air inlet delimited by an air inlet cone, an annular air outlet, a back plate, and front plate opposite said back plate;

b. a first air outlet diffusing structure operatively supported adjacent said back plate of said fan wheel so as to be substantially planar therewith; and, c. a second air outlet diffusing structure operatively supported adjacent said front plate of said fan wheel so as to be substantially non-planar therewith, either of said first or second air outlet diffusing structures including sound insulating means.

10. A fan assembly comprising:

a. a fan wheel having an axial air inlet delimited by an air inlet cone, an annular air outlet, a back plate, and front plate opposite said back plate;

b. a first air outlet diffusing structure operatively supported adjacent said back plate of said fan wheel so as to be substantially planar therewith; and, c. a second air outlet diffusing structure operatively supported adjacent said front plate of said fan wheel so as to be substantially non-planar both said first and second air outlet diffusing structures including sound insulating means.

11. A fan assembly comprising:

a. a fan wheel having an axial air inlet delimited by an air inlet cone, an annular air outlet, a back plate, and front plate opposite said back plate;

b. a first air outlet diffusing structure operatively supported adjacent said back plate of said fan wheel so as to be substantially planar therewith;

c. a second air outlet diffusing structure operatively, supported adjacent said front plate of said fan wheel so as to be substantially non-planar therewith; and, d. a third air outlet diffusing structure intermediate said first and second air outlet diffusing structures, one or more of said air outlet diffusing structures including sound insulating means.

12. A fan assembly comprising:

a. a fan wheel having an axial air inlet delimited by an air inlet cone, an annular air outlet, a back plate, and front plate opposite said back plate;

b. a first air outlet diffusing structure operatively supported adjacent said back plate of said fan wheel, said first air outlet diffusing structure including a perforated plate exposed to air flow from said annular air outlet, said perforated plate of said first air outlet diffusing structure being substantially planar with said back plate; and, c. a second air outlet diffusing structure operatively supported adjacent said front plate of said fan wheel, said second air outlet diffusing structure including a perforated plate exposed to air flow from said annular air outlet, said perforated plate of said second air outlet diffusing structure characterized by an angle of inclination θ relative to said front plate so as to result in a radially reducing width for said annular air outlet.

13. The fan assembly of claim 12 wherein said angle of inclination θ for said perforated plate of said second air outlet diffusing structure is up to about 25°.

14. The fan assembly of claim 13 wherein said perforated plate of said first air outlet diffusing structure and said second air outlet diffusing structure is characterized by a transparency index within a range of about 1,000-20,000.

15. The fan assembly of claim 13 wherein said first and second air outlet diffusing structures house acoustic insulation.

16. The fan assembly of claim 13 wherein said first and second air outlet diffusing structures house acoustic insulation having a density within a range of about 0.5-8.0 pounds per cubic foot.

17. The fan assembly of claim 13 wherein said first and second air outlet diffusing structures house acoustic insulation having a thickness within a range of about 0.05-0.1 times an outside diameter of said fan wheel.

18. The fan assembly of claim 13 wherein said first air outlet diffusing structure is characterized by an outside diameter within a range of about 1.3-1.6 times an outside diameter of said fan wheel.

19. The fan assembly of claim 13 wherein an outside diameter for said first air outlet diffusing structure is substantially equivalent to an outside diameter for said second air outlet diffusing structure.

20. The fan assembly of claim 13 wherein said first air outlet diffusing structure is characterized by an inside diameter within a range of about 0.6-0.7 times an outside diameter of said fan wheel.

21. The fan assembly of claim 13 wherein an inside diameter for said first air outlet diffusing structure is substantially equivalent to an inside diameter for said second air outlet diffusing structure.

22. The fan assembly of claim 13 wherein said perforated plate of said second air outlet diffusing structure is non-curved.

23. The fan assembly of claim 13 wherein a width for passage of air existing said annular air outlet is within a range of about 0.3-0.4 times an outside diameter of said fan wheel.

24. A fan assembly comprising:

a. a fan wheel characterized by an axial air inlet, an annular air outlet, a back plate, and front plate opposite said back plate, said fan wheel operatively supported for rotation about a central axis;

b. a first air outlet diffusing structure operatively supported adjacent said back plate of said fan wheel, said first air outlet diffusing structure including a perforated plate exposed to air flow associated with said annular air outlet, said perforated plate of said first air outlet diffusing structure being substantially planar with said back plate; and, c. a second air outlet diffusing structure operatively supported adjacent said front plate of said fan wheel, said second air outlet diffusing structure including a perforated plate exposed to air flow associated with said annular air outlet, said perforated plate of said second air outlet diffusing structure radially extending from said central axis so as to converge in a direction towards said perforated plate of said first air outlet diffusing structure.

25. A method for improving static efficiency of a fan assembly characterized by a bladed fan wheel having an axial air intake and an annular air outlet, a front plate and a back plate, the method comprising:

a. securing a first air outlet diffusing structure adjacent a periphery of the back plate of the fan assembly; and, b. securing a second air outlet diffusing structure adjacent a periphery of the front plate of the fan assembly, said second air outlet diffusing structure including a perforated plate exposed to air flow from the annular air outlet, said perforated plate of said second air outlet diffusing structure characterized by an angle of inclination θ relative to the front plate so as to result in a radially reducing width for the annular air outlet.

* * * * *